US006601607B1

(12) United States Patent
Pratt

(10) Patent No.: US 6,601,607 B1
(45) Date of Patent: Aug. 5, 2003

(54) SUMP PUMP DISCHARGE WATER ESCAPE SYSTEM

(76) Inventor: James M. Pratt, P.O. Box 920624, Needham, MA (US) 02492

( * ) Notice: Subject to any disclaimer, the term of this patent is extended or adjusted under 35 U.S.C. 154(b) by 0 days.

(21) Appl. No.: 10/034,465

(22) Filed: Jan. 3, 2002

(51) Int. Cl.[7] ..... E03B 7/10
(52) U.S. Cl. ..... 137/357; 138/32
(58) Field of Search ..... 137/357, 561 A, 137/862

(56) References Cited

U.S. PATENT DOCUMENTS 4,620,817 A * 11/1986 Cushing ..... 435/43
5,007,451 A * 4/1991 Bralich ..... 137/362
5,114,594 A * 5/1992 Rosebrock et al. ..... 138/32
5,313,677 A * 5/1994 Coe ..... 4/683
5,533,303 A * 7/1996 Harvey ..... 52/16
5,746,254 A * 5/1998 Janesky ..... 138/32

* cited by examiner

*Primary Examiner*—John Fox
(74) *Attorney, Agent, or Firm*—William Nitkin

(57) ABSTRACT

A sump pump discharge system having a water escape member interposed between a sump pump exit pipe and a drain pipe, such water escape member being a truncated conical structure having a plurality of upright ribs extending from its base to its top defining a plurality of elongated discharge openings therebetween and, in one embodiment, having a valve disposed above the water escape member to direct water through a hose having a first end and a second end, the second end of which is manually positioned at a desired location for aiding the escape of water from the exit pipe.

2 Claims, 3 Drawing Sheets

SUMP PUMP DISCHARGE WATER ESCAPE SYSTEM

BACKGROUND OF THE INVENTION

1. Field of the Invention

The system of this invention resides in the area of sump pump discharge water escape systems and more particularly relates to a system for the discharge of water from a sump pump to the exterior of a building where such discharge system includes a water escape structure for the release of water to the exterior of such building even when the drain pipe has become blocked, such as by ice or snow.

2. History of the Prior Art

Water escape devices for freeze-prone sump pump discharge systems are known in the art. One example of such device is described in U.S. Pat. No. 5,746,254 to Janesky. In this patent a water escape device is interposed within a portion of the discharge pipe at the exterior of the building above the ground such that if the drain pipe becomes icebound, water will back up and escape through openings in the water escape device and flow out onto the ground.

SUMMARY OF THE INVENTION

It is an object of this invention to provide an improved sump pump discharge water escape system. Typically a sump pump is interconnected through drain pipes to the exterior of a building where such drain pipes extend down into the ground. In this invention an improved water escape member is interposed between the through-wall exit pipe and the drain pipe which extends into the ground. If water freezes within the drain pipe, the water flow will back up and rather than pass back into the sump and basement of the building which action could cause damage, the water will escape through the discharge openings in the water escape member which openings are arrayed in a 360-degree circumference. In addition, if it is desired for the water to pass to another area for drainage, a valve is provided on the water escape pipe which, when engaged, directs water through a hose member which can be extended to reroute the water flow to another area. There are holes drilled in the stopped check valve to reduce ice buildup. The water escape device is shaped like a truncated cone which extends between the upstream narrower, generally 1½-inch in diameter exit pipe at its top and the wider, generally 4-inch wide drain pipe at its base. The water escape device has a plurality of vertically disposed ribs extending therearound from its base to its top which define elongated discharge openings therebetween to allow the escape of water therefrom in a circular area around the device. This feature is an improvement over Janesky, U.S. Pat. No. 5,746,254 as it allows more water to escape in a 360-degree area as opposed to only the 180-degree area of the prior art, thus allowing more water to escape and reducing the chance of freeze-up.

DESCRIPTION OF THE PREFERRED EMBODIMENT(S)

Figure 1:
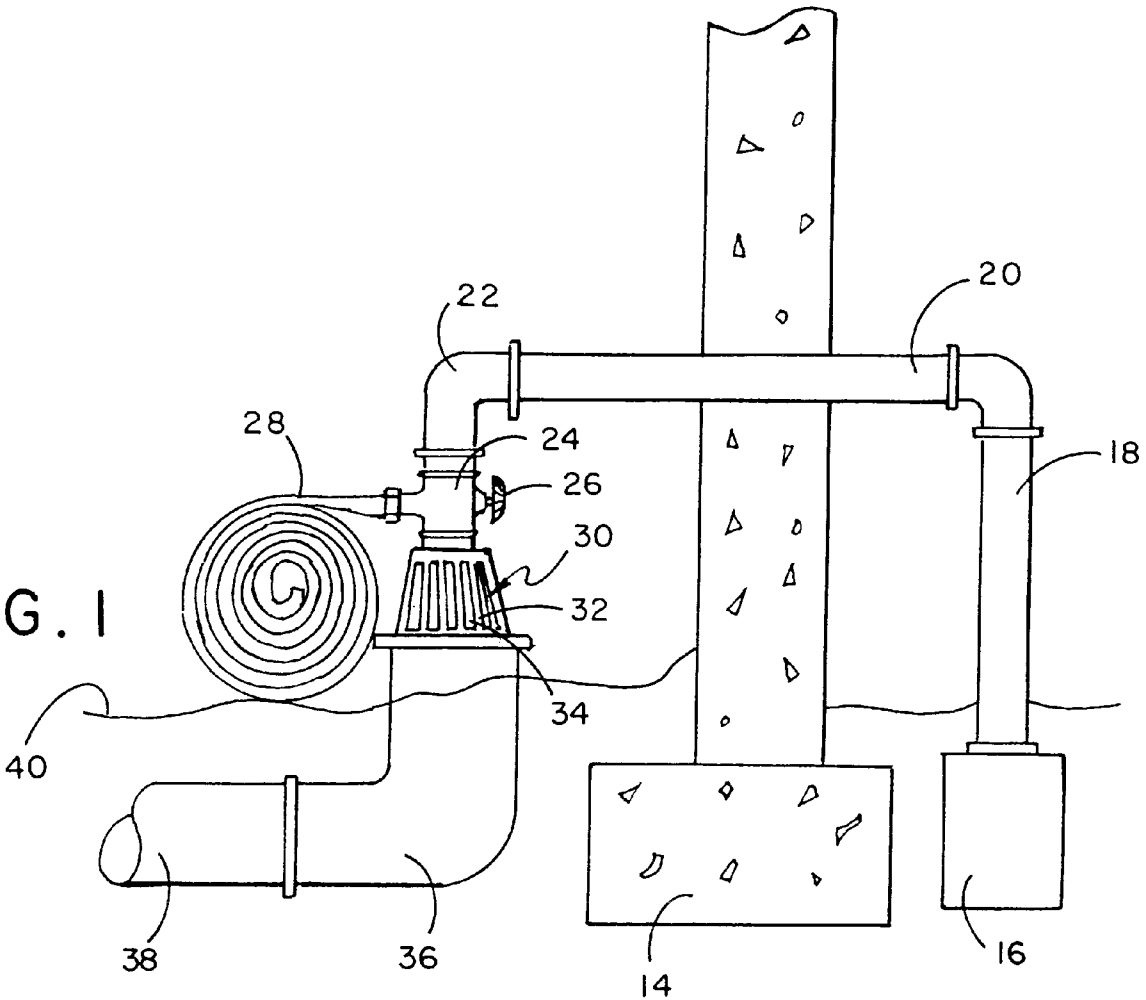
FIG. 1 illustrates a side view of the sump pump drain and the device of this invention through a section of basement and building exterior.
Figure 2:
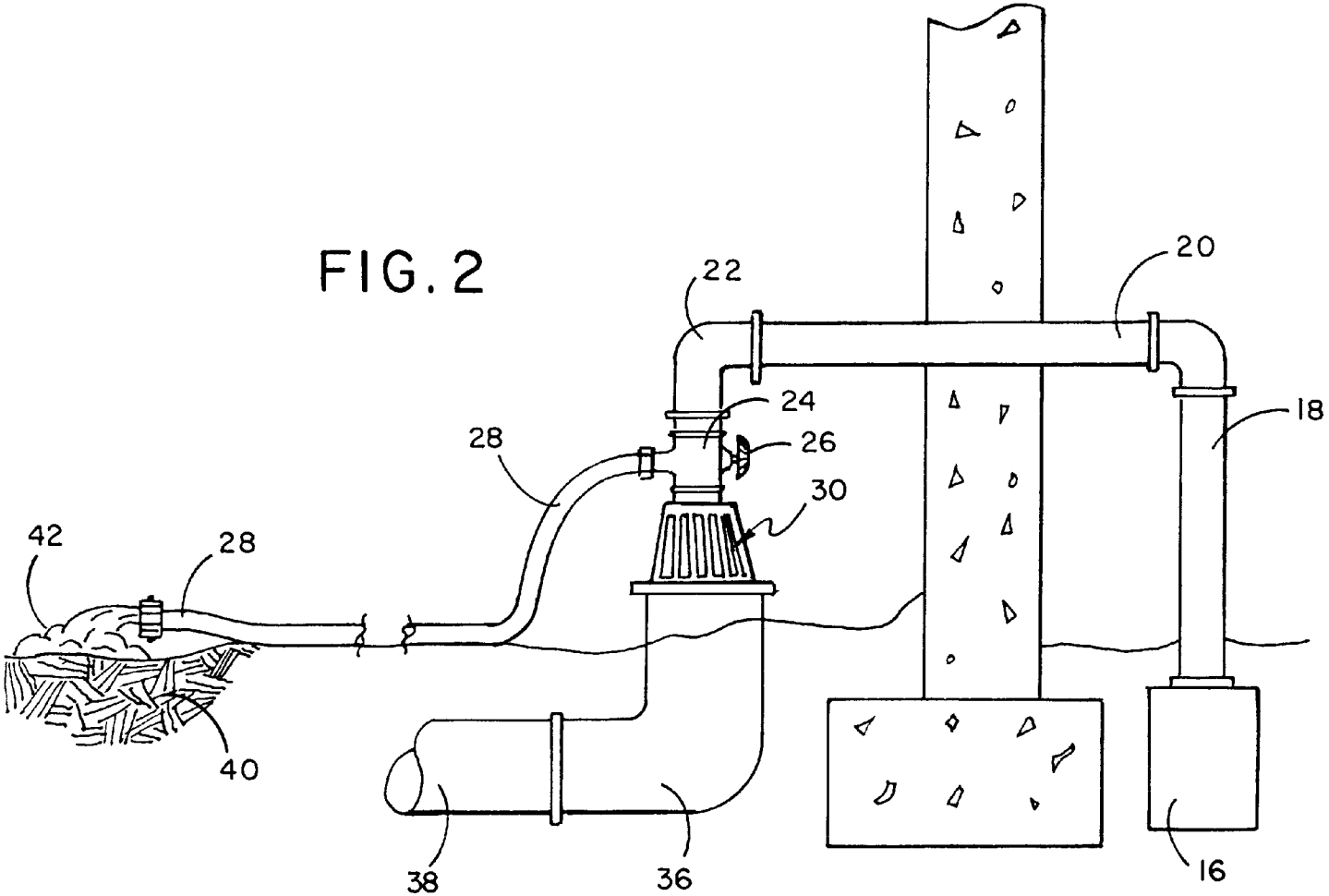
FIG. 2 illustrates the view of FIG. 1 wherein the hose member has been unrolled to reroute the water flow.
Figure 3:
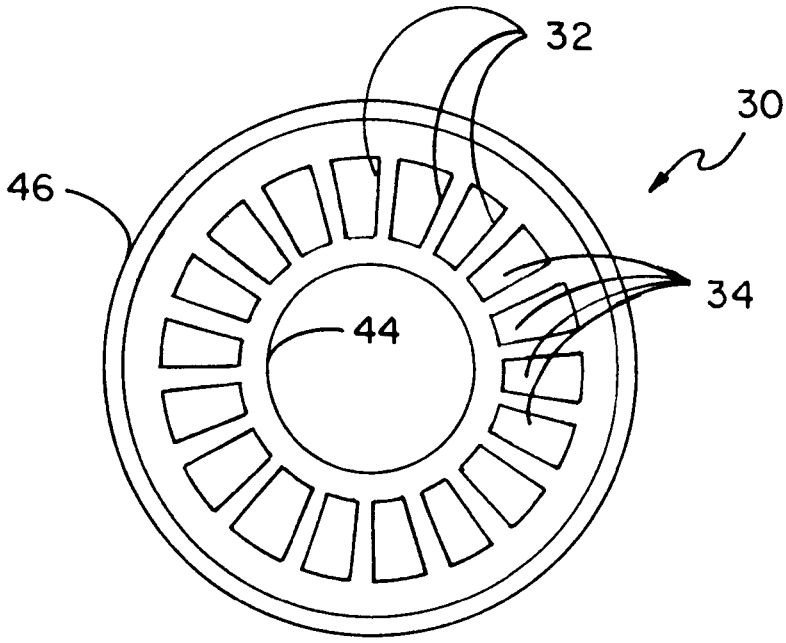
FIG. 3 illustrates a bottom view of the water escape member.

Seen in FIG. 1 is sump pump 16 which is connected by vertically disposed pipe 18 to a horizontally extending through-wall pipe 20 which is engaged to a downwardly extending exit pipe 22 which would normally pass directly to a drain pipe 36 in the ground for the water to be drained away. During winter, though, such drain pipes can freeze, causing a backup of water through exit pipe 22, back through the through-wall pipe 20, and down vertically disposed pipe 18 into sump pump 16 where it can flood the basement and cause damage. To prevent such occurrence, a water escape member 30 is interposed between exit pipe 22 and drain pipe 36. Water escape member 30 can be made of PVC plastic in the form of a truncated cone approximately 6 inches in height extending between exit pipe 22 and drain pipe 36. Top 44 of water escape member 30, also seen in FIG. 3, is approximately 2 inches in diameter to accept exit pipe 22, and bottom 46 of water escape member 30 is approximately 4 inches in diameter to fit and engage drain pipe 36. Ribs 32 are generally narrower than openings 34. Ribs 32 are generally spaced equidistant from one another around top 44 and radiate outwards to be equally distant from one another around bottom 46. Plurality of ribs 32 of water escape member 30 extend upwards in general vertical alignment with one another and define therebetween a plurality of elongated, vertically upright discharge openings 34 disposed around its circumference. In one embodiment a water discharge and rerouter can be disposed above water escape member 30 which water discharge and rerouter can be used if one wants to reroute the discharge away from drain pipe 36 or away from the building should water be coming out of water escape member 30 or if water escape member 30 itself should become plugged with ice. Ice buildup can also occur from melting ice from gutters which re-freezes, and snow and ice buildup can occur on the ground in front of a roof overhang. Valve 24 can be opened by the rotation of handle 26 which then blocks water from passing into water escape member 30 and directs water through hose connector 27 into hose 28 which is shown in FIG. 1 in a coiled storage position. When in use, as seen in FIG. 2, hose 28 can be uncoiled to extend along ground 40 so that it can discharge water 42 at whatever location the end of hose 28 is positioned in. It has been found that the combination of water escape member 30 and hose discharge system provides a very versatile water escape system for use with sump pump discharges, and such invention is especially useful in freezing weather or when large volumes of water need to be discharged from the basement area by the sump pump.

Although the present invention has been described with reference to particular embodiments, it will be apparent to those skilled in the art that variations and modifications can be substituted therefor without departing from the principles and spirit of the invention.

I claim:

1. A sump pump discharge water escape system for the flow of water of the type having an exit pipe passing through the foundation of a structure and extending to a drain pipe within the ground, comprising:

a water escape member having a top and a base, said water escape member interposed between said exit pipe and said drain pipe, said water escape member comprising a truncated conical structure having a circumference and having a plurality of upright ribs disposed therearound extending from said base to said top and defining therebetween a plurality of elongated discharge openings for the escape of water therethrough around said entire circumference.

2. The sump pump discharge water escape system of claim 1 further including:

a hose member having a first and second end, said second end of said hose member adapted to be positionable at a desired location; and a valve interposed between said top of said water escape member and said exit pipe, said valve, when actuated, directing water flow to said first end of said hose member, said valve, when actuated, diverting water flow from said exit pipe away from said drain pipe through said first end of said hose member to said desired location where said second end of said hose member is positioned.

* * * * *